US005852255A

United States Patent [19]

Hallis et al.

[11] Patent Number: 5,852,255

[45] Date of Patent: Dec. 22, 1998

[54] NON-TOXIC FRANGIBLE BULLET CORE

[75] Inventors: John M. Hallis, Buffalo; Richard W. Proulx, Forest Lake, both of Minn.

[73] Assignee: Federal Hoffman, Inc., Anoka, Minn.

[21] Appl. No.: 885,887

[22] Filed: Jun. 30, 1997

[51] Int. Cl.[6] ..... F42B 5/02; F42B 12/34

[52] U.S. Cl. ..... 102/439; 102/398; 102/506; 102/516; 102/517; 102/529

[58] Field of Search ..... 102/398, 474, 102/501, 506–511, 514–518, 529, 430, 439

[56] References Cited

U.S. PATENT DOCUMENTS

| | | | |
|---|---|---|---|
| 216,974 | 7/1879 | Rice . | |
| 914,992 | 3/1909 | Taylor . | |
| 1,892,152 | 12/1932 | Jones . | |
| 2,123,981 | 7/1938 | Whipple . | |
| 2,303,449 | 12/1942 | Fleischmann . | |
| 2,345,619 | 4/1944 | Moore . | |
| 2,762,108 | 9/1956 | Friedman . | |
| 2,958,115 | 11/1960 | Lyon . | |
| 2,958,287 | 11/1960 | Auxier . | |
| 3,003,420 | 10/1961 | Nosler . | |
| 3,097,603 | 7/1963 | Harper . | |
| 3,143,966 | 8/1964 | Burns, Jr. et al. . | |
| 3,173,371 | 3/1965 | Manshel . | |
| 3,208,386 | 9/1965 | Schneider et al. | 102/506 |
| 3,349,711 | 10/1967 | Darigo et al. . | |
| 4,949,645 | 8/1990 | Hayward et al. . | |
| 5,394,597 | 3/1995 | White . | |
| 5,454,325 | 10/1995 | LeBlanc . | |
| 5,528,989 | 6/1996 | Briese | 102/506 |
| 5,569,874 | 10/1996 | Nelson | 102/507 |
| 5,679,920 | 10/1997 | Hallis et al. | 102/506 |

FOREIGN PATENT DOCUMENTS

| | | |
|---|---|---|
| 72702 | 1/1894 | Germany . |
| 3819251 A1 | 12/1989 | Germany . |
| 3840465 A1 | 7/1990 | Germany . |
| 8902864 | 11/1989 | Netherlands . |
| 11087 | of 1901 | United Kingdom . |

*Primary Examiner*—Harold J. Tudor
*Attorney, Agent, or Firm*—Schroeder & Siegfried P.A.

[57] ABSTRACT

A non-toxic, highly frangible elongated soft-point training round bullet core which will disintegrate upon striking its target, for use in a training round in training exercises for law enforcement personnel and having a central heart of non-toxic metal selected from a group consisting of zinc, iron, steel, and copper with a plurality of wires of non-toxic metal selected from that group twisted around said heart throughout its length prior to being swaged into deforming and inter-engaging relation with the heart, and the core having been subsequently swaged into the shape of a soft-point nose of a bullet, with pressures sufficient to cause the strands of wire and the heart to inter-engage and deform while retaining their individuality at least to a limited extent, whereupon substantially all of the strands of the core, upon the core being fired and striking a target, will fragment along at least some of their original physical boundaries into discrete fragments smaller than the original size of the bullet.

25 Claims, 3 Drawing Sheets

NON-TOXIC FRANGIBLE BULLET CORE

This invention is related to our copending application for patent entitled NON-TOXIC FRANGIBLE BULLET, Ser. No. 08/510,747, filed Aug. 3, 1995, now U.S. Pat. No. 5,679,920. The contents thereof are made a part hereof by reference thereto.

This invention is closely related to an application being filed at this time by us, which is directed to the method of manufacturing the product described and claimed herein, and entitled METHOD OF FORMING A NON-TOXIC FRANGIBLE BULLET CORE, Ser. No. "08/905,152, filed Aug. 1, 1997". The contents of said application are included herein by reference thereto.

BACKGROUND OF THE INVENTION

The background of the instant invention is the same as, or at least highly similar to, that set forth in our above-entitled allowed application. Consequently, the background material set forth in said prior application is hereby repeated and included herein by reference thereto.

In addition to the above, we have found that certain problems in line manufacturing of the non-toxic frangible bullet can be solved if the teachings outlined hereinafter are utilized. Some of the steps in manufacturing this bullet on a production-line basis require a very positive gripping of one end portion of the slug. Such a gripping is required if the slug is to be successfully moved to succeeding positions for subsequent manufacturing steps. Such a gripping necessitates that the slug maintain its desired form, for if its form crumbles enroute from one manufacturing station to another, the entire production line is held up. We find that the particular bullet core shown and claimed herein substantially facilitates the production-line manufacture of the bullet core, described and claimed, because it withstands and facilitates the mechanical handling which it must undergo while being completed. We also find that the particular construction, method of manufacture and composition of this bullet core enhances the extent to which the core fragments, upon impact, when it strikes its target.

Also, it is important for improved accuracy, that the bullet core be well-balanced. The particular construction of the bullet core claimed herein provides such an improved balance. We have discovered that these problems are overcome to a substantial extent if the bullet core is constructed in accordance with the descriptive material as disclosed and claimed hereinafter.

In the past, lead cores have been most commonly used in bullets fired in target houses or shooting rooms. Such bullets present serious drawbacks in that their use produces substantial amounts of "bounce-backs," lead particles in the air, ricochets, and errant penetration. A definite need exists, therefor, for a bullet core which will obviate these adverse features.

Although we have found zinc functions very well in the manufacture of a NON-TOXIC FRANGIBLE BULLET, we believe that copper, steel and iron may also function to minimize the above adverse conditions. We anticipate, however, that copper, steel, and iron will function less satisfactorily than zinc because they have different annealing properties which may require a separate annealing procedure subsequent to the swaging application to permit additional forming steps and, thus, makes them less desirable for the purpose indicated herein. Consequently, we have directed our attention primarily to the use of zinc, preferably with a high zinc content.

BRIEF SUMMARY OF THE INVENTION

We have discovered that, if a very high grade of zinc is utilized in the making of a bullet core, such a core will become quite brittle when it is work-hardened. More importantly, however, we have discovered that, when a zinc bullet core strikes its target, the impact of the bullet, upon striking the target, magnifies the extent to which the zinc metal hardens, and causes the bullet core to become very brittle and disintegrate upon impact with its target. Consequently, in forming the bullet cores of this invention, we utilize the purest zinc obtainable, which is 99.99% zinc, the balance being, in general, impurities. A minimum zinc content is believed to be approximately 95% zinc.

Our theory is that the impact, created when the zinc bullet core strikes its target, work-hardens the substantially all-zinc bullet core additionally and very markedly, with the result that the bullet core becomes very brittle and shatters into fragments, all of which are less than only about 12% of the original size of the cable segment from which the fragment originated.

The above discovery was made as a result of forming the slug from which the bullet is swaged, from zinc wires. We make the slug at its heart from a bundle of straight zinc wires, which are bound tightly together by additional all-zinc wires, which are twisted around the heart wires along a 33° spiral, to form a zinc cable or rod. In so doing, the strands of zinc wire inter-engage each other and are slightly deformed. We then run the cable through a machine which cuts segments off the cable and swages same into the desired shape of the bullet core. Thereafter, we transfer the swaged core to a machine which applies a copper jacket to the cylindrical end of the core. This application completes the formation of the bullet core, except for washing, etc.

The swaging is performed with sufficient pressure (36,000–50,000 psi) to form same into the shape of a soft-point bullet core. These pressures are sufficient to cause the encircling wires to further inter-engage and deform the central wires, as well as themselves, while retaining their individuality, at least to a limited extent, which is visible to the naked eye. The preferred pressure which we utilize is about 45,000 psi.

The hardening which is caused by the impact of the bullet core when it strikes its target, causes the bullet core upon striking a target to disintegrate along the visible retained lines of individuality of the wires and causes the individual wires to break up into fragments smaller than their original size or lengths. This fragmentation occurs in the central heart wires, as well as in the outer zinc wires which are twisted thereabout.

In the line-production manufacture of the above NON-TOXIC FRANGIBLE BULLET CORE, we assemble a central bundle (heart) of seven (7) straight parallel elongated wires of 99.99% zinc and twist a plurality of five (5) similar zinc wires tightly around the bundle at an acute angle of about 33° to the longitudinal center of the bundle, to produce the cable or rod, from which segments slightly longer than the desired bullet core are cut. One of the seven straight wires is disposed at the center of the heart and the other six (6) are arranged in a circular pattern around the single centrally disposed wire. We use seven wires of the same diameter, because then the six wires surrounding the central wire come closest to defining a circle with their outer surfaces, when so arranged. Such segments are then pressure-formed (swaged), as described, into the desired shape of a soft-point bullet.

Thereafter, the copper jacket is applied to the cylindrical rear portion of the core, and affixed thereto, by an additional pressure-forming operation in which pressure is applied to cause the jacket to fixedly attach to the swaged zinc shape.

Wherever hereinafter reference is made to a soft-point bullet core, it is intended to connote a core which has a cylindrical rear portion and extends forwardly beyond the jacket and slopes inwardly toward the forward end of the nose, which is smooth.

BRIEF DESCRIPTION OF THE DRAWINGS

These and other objects and advantages of the invention will more fully appear from the following description, made in connection with the accompanying drawings, wherein like reference characters refer to the same or similar parts throughout the several views, and in which.

DETAILED DESCRIPTION OF THE INVENTION

Figure 1:
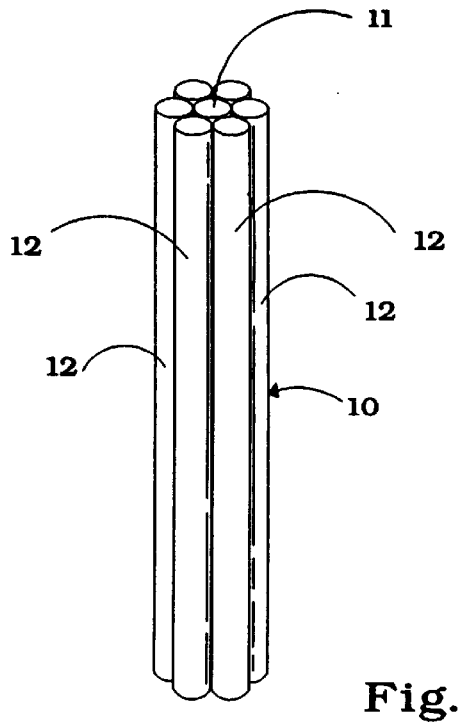
FIG. 1 is a perspective view of seven (7) zinc wires which constitute the heart of the bullet core of the preferred form of the invention, as initially assembled.

As previously indicated hereinbefore, the preferred method of forming a non-toxic frangible bullet core, in accordance with the invention, is disclosed in FIGS. 1–8. FIG. 1 shows a bundle 10 of straight parallel wires made of zinc, which are arranged with one 11 of the wires surrounded by six similar wires 12, so that their exterior surfaces come closest to defining a circular configuration around the central wire 11. This bundle 10 constitutes the heart of a zinc cable 13, which is formed by tightly wrapping a plurality of five zinc wires 14 around the bundle 10 at an angle approximating 33° to the longitudinal center of the bundle. These five wires 14 are drawn tightly enough around the bundle 10, so that the wires 14 inter-engage with other and slightly deform each other. In addition, they engage each of the wires 12 under sufficient tension, so that they inter-engage and slightly deform the wires of the heart 10. As a result of the wires 14 being twisted around the bundle 10, the zinc cable or rod is formed. These wires are so tightly drawn that it is possible to cut segments off the cable or rod and to handle same, either manually or mechanically, without the wires losing their positions relative to each other. In other words, such a segment will not come apart or disintegrate as a result of such handling.

Figure 2:
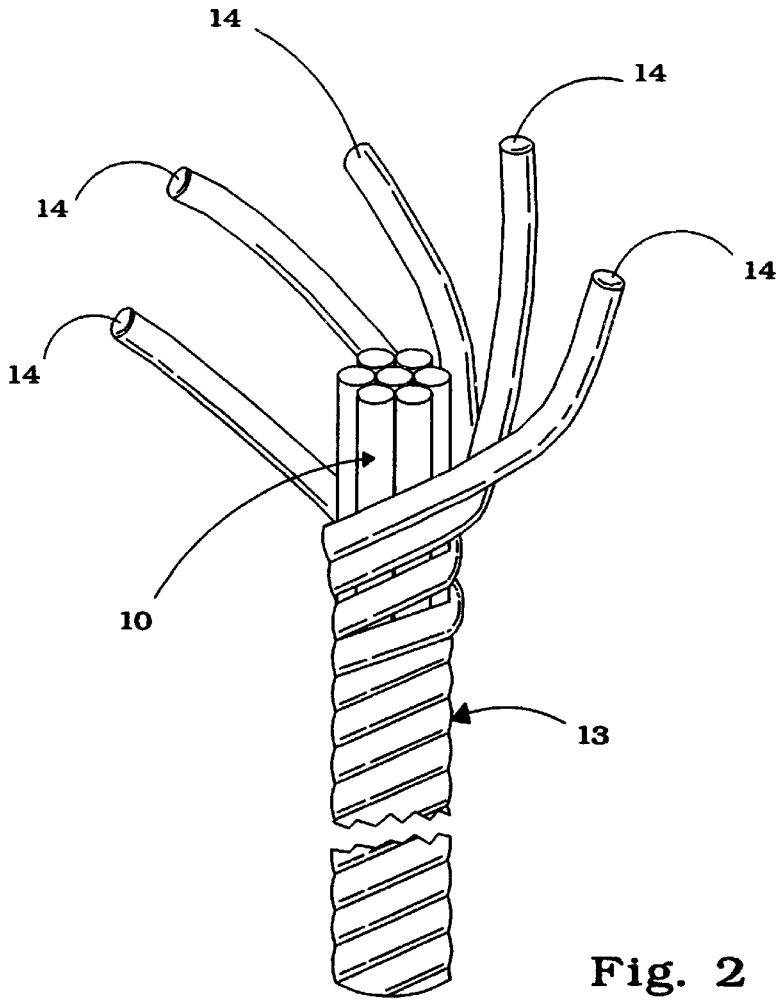
FIG. 2 is a perspective view showing the heart of the core of FIG. 1 having five (5) zinc wires of the same size as those in the heart, being wrapped tightly around the heart wires.

FIG. 2 shows the five wires 14 being wrapped around the bundle 10, as indicated hereinabove. The wires 14 are maintained under tension, as they are wrapped therearound.

Figure 3:
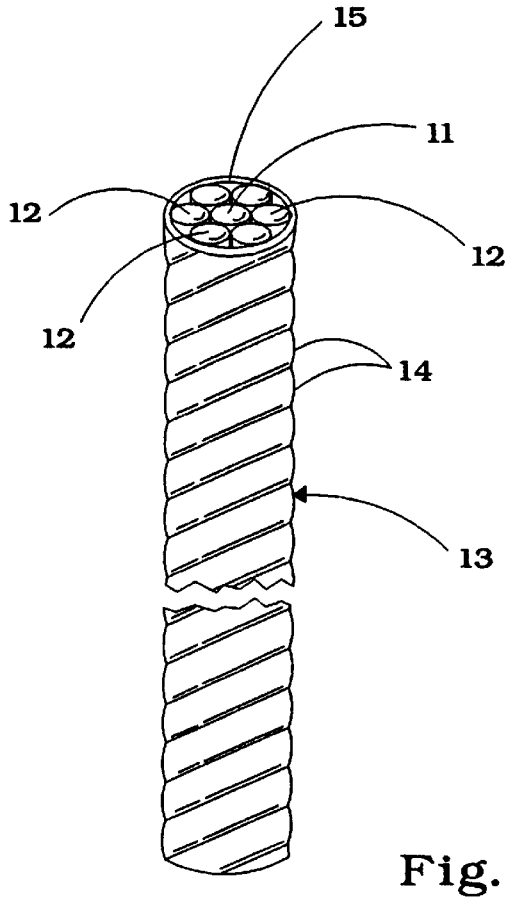
FIG. 3 is a perspective view of the cable as it appears when the operation shown in FIG. 2 is complete, with an intermediate section broken away.

FIG. 3 shows the cable 13 with a central portion as it appears when the terminal portion is severed from the main body of the cable. It will be seen that the wires 14 form a sheath or jacket around the bundle 10, which functions to hold the bundle 10 in compact fixed relation to the sheath 15, which is comprised of the five zinc wires 14.

Figure 4:
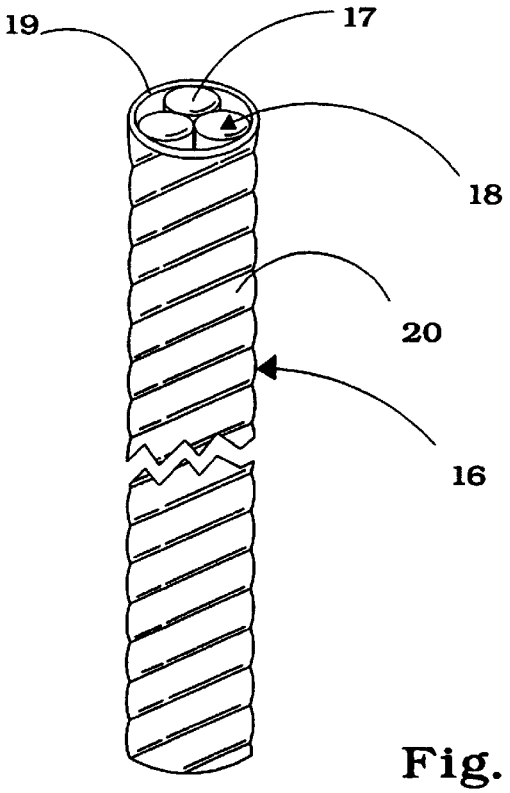
FIG. 4 is a perspective view of a cable similar in size to that of FIG. 3 but having a heart comprised of only three (3) parallel central wires.

FIG. 4 shows a cable 16 formed in the same manner as cable 13, with the exception that three parallel wires 17 comprise the bundle, which comprises the heart 10, which is encased within a similar sheath 19, which is comprised of five wires 20, each of which is similar to the wires 14. The only difference between the cables 13 and 16 is that the bundle 18 is comprised of three zinc wires which are slightly larger in diameter than the diameter of the wires or strands 12. Either of the two cables 13 or 16 will function adequately to furnish slugs which may be cut therefrom and swaged into a non-toxic frangible bullet core, as described hereinafter.

As the formation of the cable 13 or 16 is completed, it is fed in line into a swaging machine for the purpose of cutting a segment off the cable of a size appropriate for the dimensions of the bullet core to be formed. We utilize the Model No. 250-C-SSS-D Swaging Machine, formerly manufactured by The E. J. Manville Machine Co., Inc., which is a 30-ton Press, Crank, Horizontal Swaging Device, now available from Behr Machinery and Equipment Corporation, Box 740, Rockford, Ill., U.S.A. This machine will cut a segment off the cable of an appropriate length, to which it may be set, and mechanically grips one end of that segment and then presents the same to the swaging die of the machine.

Figure 5:
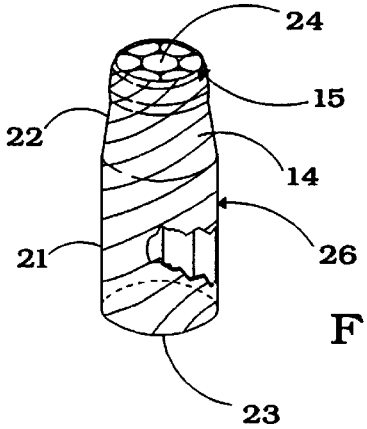
FIG. 5 is a perspective view of a bullet core embodying the invention prior to the application of the copper jacket thereto.

The above swaging machine then proceeds to swage the segment of cable by compressing it longitudinally into the desired soft-nose shape and size of the desired bullet core. This swaging operation compresses the segment of the cable 13 or 16, as the case may be, to such an extent that the exterior wires 14 and the wires of the heart 10 are further inter-engaged and deformed into a composite shape, such as is shown in FIG. 5. It will be seen that the general outline of the bullet core has, at this stage, been formed, in that it has a cylindrical rear portion 21 which tapers inwardly, as at 22, towards its forward or nose end, and tightly encases the heart 10. As shown, the core has a rear end 23 and a forward or nose end 24. It will also be seen that the individual zinc wires 14 retain their original physical individuality, at least to a limited extent, which is discernible to the naked eye. It is estimated that approximately 90 to 95% of the inter-engagement and deformation of the outer wires 14 of the sheath 15 and the wires of the heart 10 is accomplished in this swaging operation. It is estimated that approximately 5–10% of the inter-engagement and deformation of said wires is accomplished in the initial formation of the cable or rods 13 and 16, as hereinbefore described.

Figure 6:
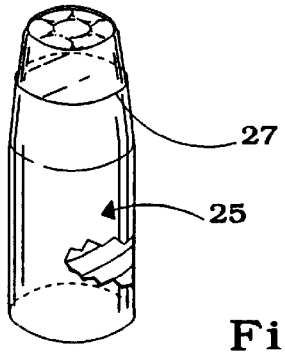
FIG. 6 is a perspective view of the complete bullet core embodying the invention.

Once the swaging described hereinabove has been completed, the basic core configuration, as shown in FIG. 5, is mechanically transferred to the final formation station, which consists of a Waterbury Farrel Machine, which is designed to apply a copper jacket 25 to the basic zinc core 26, as shown in FIG. 6. As shown in FIG. 6, the rear end 23 of the core 26 is introduced into the open end 27 of the jacket 25. We utilize a Waterbury Farrel Machine, the 6600 Special model, which was formerly available from the Waterbury Farrel Foundry & Machine Co., and is now available from Waterbury Farrel Products, division of Jones & Lamson, located at 750 West Johnson Avenue, Cheshire, Conn. 06410, U.S.A. Here the copper jacket is applied to the rear end of the swaged slug member 26, and the formation of the bullet core is completed by further compressing the swaged slug member 26 within that copper jacket 25, to complete the formation of the bullet core. The basic core 26 and copper jacket 25 are compressed, so as to cause the jacket 25 to fit tightly and securely around the rear end portion of the basic bullet core 26. This completes the formation of the non-toxic frangible bullet 28, which is shown in FIG. 8 mounted within the mouth 29 of a brass cartridge casing 30, in the conventional manner utilized in the manufacture of a cartridge.

Figure 7:
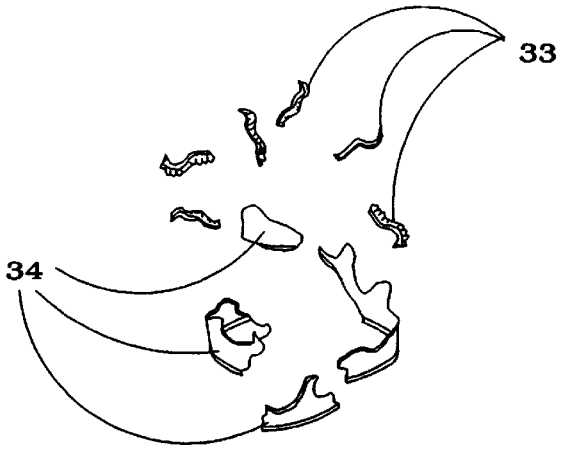
FIG. 7 is a perspective view showing the degree of fragmentation of the bullet core embodying the invention, upon impact with its target.
Figure 8:
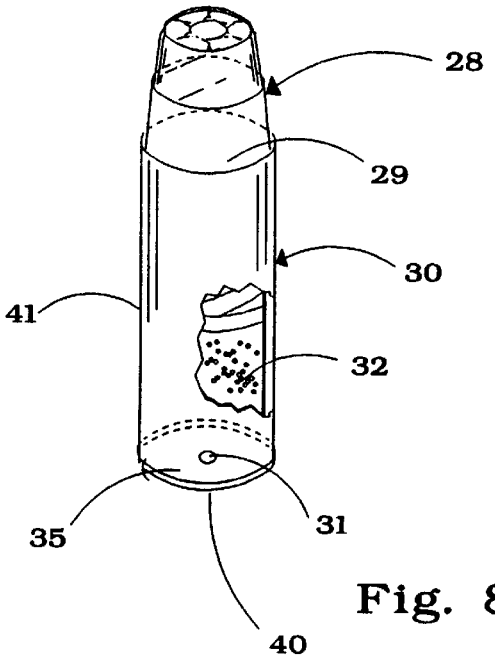
FIG. 8 is a perspective view, with portions broken away, showing a bullet core embodying the invention, mounted within a centerfire brass casing.

As shown in FIG. 8, the brass casing 30 has an open mouth 29, a primer 31, and propellant 32 therewithin. The propellant is located in close proximity to the primer 31, so that it will be fired upon detonation of the primer 31, and the bullet 28 will be expelled by the ignited propellant 32 from the open mouth 29 of the cartridge. As suggested hereinbefore, it is believed that the working of the zinc wires 12 and 14, of the segment of cable 13, work-hardens the zinc material from which said wires are made, but the self-annealing properties of zinc enables the manufacturing process to continue without interruption or an additional annealing step. In addition, it is believed that the effect of the impact of the bullet core, when it strikes its target, again work-hardens the zinc sufficiently, so as to make it adequately brittle to cause the same to disintegrate and break up into fragments which are substantially smaller than any of the initial wires. This is best shown in FIG. 7, in which the small fragments of wire and of the copper jacket are depicted. It will be seen therefrom that the fragments of zinc identified by the numeral 33 show the effects of the inter-engagement and deformation thereof resulting from the swaging and the formation of the cable 13, when the wires 14 are tightly wrapped around the bundle or heart 10. It will be seen also that the copper jacket 25 has fragmented into fragments 34. We have swept the interior of a shooting range for bullets manufactured in accordance with the invention herein, and have found no fragment of a size exceeding 12% of the initial size of the bullet. Most, if not all, of the particles are substantially smaller than 12% of the original size of the cable segment.

It will be seen, by reference to FIGS. 3–8, that the wires of the central core or heart 10 of the cables 13 and 16 extend throughout the length of the core. We have found that each strand of the heart is deformed and inter-engaged with the outer strands of wire 14.

We prefer to utilize zinc wires which are 99%–99.99% zinc, for it appears that the higher zinc content facilitates the disintegration of the individual strands into the much smaller fragments. The preferred range of zinc which we utilize is 99.99% zinc, which is the purest form of zinc which is available, the balance being in the form of impurities. It is believed that the minimum percentage of zinc to be utilized, in the form of an alloy, is approximately 95% zinc.

As shown in FIG. 8, the casing 30 has a mouth 29, a head 35, a rim 40, and a main body portion 41.

The non-toxic frangible bullet core described hereinabove has highly desirable physical characteristics in that it disintegrates into relatively small fragments, when the bullet core strikes its target, as hereinbefore indicated. The advantage of such a bullet core lies in the fact that the fragmentation of the core, at the point of impact, has proved to eliminate the dangers and disadvantages of bounce-back, ricochetting, and errant penetration, as hereinbefore described. When bullet cores having the properties outlined herein are utilized, there is no real danger or disadvantage connected therewith with respect to these problems. In addition, since zinc is non-toxic, there is no problem of a toxic-containing atmosphere within the shooting range, which heretofore has been created by the firing of lead bullets.

In addition to the above, a manufacturer of a bullet core, as disclosed and claimed herein, offers very distinct advantages in that the practice of utilizing on-line manufacturing of the bullet cores is feasible and cost-effective, since the segment of the cables 13 and 16 are structurally compact and capable of being handled mechanically, without crumbling or otherwise disintegrating, so that it is now possible for the forming machines to operate satisfactorily on an on-line basis. We have found that the segment of the cables 13 or 16 can be gripped positively with the swaging machine immediately subsequent to the cutting of the segment of the cable, so that it can be effectively and safely transferred mechanically to a position where the forward end of the segment is presented to the swaging die in a longitudinally oriented position. As a result thereof, a serious problem of manufacture has been overcome, so that an on-line manufacture of such non-toxic frangible bullet cores has been made possible, without serious handling problems of the segments from which bullet core is to be manufactured.

It will, of course, be understood that various changes may be made in the form, details, arrangement and proportions of the parts without departing from the scope of the invention which comprises the matter shown and described herein and set forth in the appended claims.

We claim:

1. In. a non-toxic, highly frangible, soft-point training round bullet core which will disintegrate upon striking its target, for use in a training round in training exercises for law enforcement personnel, comprising:

(a) a slug member made of zinc;

(b) said member having a cylindrically shaped rear portion, an inwardly tapering forward nose portion, and a soft-point nose;

(c) said member being comprised of an elongated heart made of zinc extending longitudinally and centrally of said member, and a plurality of strands of zinc wrapped around said heart in tight encircling inter-engaging relation at an acute angle thereto;

(d) said heart and said strands of zinc having had separate original physical boundaries and having been swaged into shapes with 36,000–50,000 psi pressure to cause said strands to inter-engage said heart and deform each other while retaining their individuality at least to a limited extent, and to cause each of said strands, upon said member being fired and striking a target, to disintegrate along at least some of their original physical boundaries into discrete fragments smaller than the original size of said strands.

2. The bullet core defined in claim 1, wherein said strands of zinc are twisted around said heart.

3. The bullet core defined in claim 1, wherein said heart and said strands have been deformed into inter-engaging relation.

4. The bullet core defined in claim 1, wherein said heart is comprised of a plurality of parallel strands of zinc.

5. The bullet core defined in claim 1, wherein said heart is comprised of a plurality of substantially parallel strands of zinc.

6. The bullet core defined in claim 1, wherein the original physical boundaries of said plurality of strands of said zinc are readily discernable to the naked eye subsequent to being so swaged.

7. The bullet core defined in claim 1, wherein said heart is comprised of a plurality of strands of zinc extending generally parallel to each other throughout the length of said member.

8. The bullet core defined in claim 1, wherein said heart is comprised of a plurality of elongated strands of zinc extending generally parallel to each other.

9. The bullet core defined in claim 1, wherein said heart is comprised of a plurality of elongated strands of zinc at least some of which are physically deformed by the swaging, relative to their original physical boundaries.

10. The bullet core defined in claim 1, wherein said heart is comprised of a plurality of elongated strands of zinc, each of which is physically deformed by the swaging relative to its original physical boundaries.

11. The bullet core defined in claim 1, wherein said plurality of strands are twisted into inter-engaging relation with said heart.

12. In a non-toxic, highly frangible, soft-point training round bullet core which will disintegrate upon striking the target, for use in a training round in training exercises for law enforcement personnel, comprising:

(a) a slug member made up of zinc;

(b) said member having a cylindrically shaped rear portion and an inwardly tapering forward nose portion and being comprised throughout of elongated strands of zinc;

(c) said member being comprised of a heart made of a plurality of straight parallel wires made of zinc and a plurality of strands of zinc twisted around said parallel wires of metal in deforming inter-engaging relation; and (d) said heart and said strands of zinc having had original physical boundaries and having been swaged into shapes with sufficient pressure to cause said wires and strands to deform and inter-engage with each other while retaining their individuality at least to a limited extent, and to cause substantially all of said wires and strands, upon said member being fired and striking a target, to disintegrate along at least some of their original physical boundaries into discrete fragments smaller than their original size.

13. The bullet core defined in claim 12, wherein said strands of zinc are twisted around said heart along a spiral path.

14. The bullet core defined in claim 12, wherein said heart is comprised of seven (7) wires extending from the nose of said member to its rear end.

15. The bullet core defined in claim 12, wherein said heart is comprised of a plurality of zinc wires extending centrally of said member from its nose to its rear end.

16. The bullet core defined in claim 12, wherein said strands of zinc extend along a spiral path from the rear end of said member to its nose.

17. The bullet core defined in claim 12, wherein said heart is comprised of a plurality of zinc wires extending in deformed and inter-engaging relation with each other.

18. The bullet core defined in claim 12, wherein said heart is comprised of seven (7) zinc wires and said strands of zinc twisted therearound are five (5) in number.

19. The bullet core defined in claim 12, wherein said heart is comprised of seven (7) zinc wires.

20. The bullet core defined in claim 12, wherein said heart is comprised of at least three (3) zinc wires.

21. The bullet core defined in claim 12, and (e) a jacket made primarily of copper and enclosing said cylindrically shaped rear portion.

22. The bullet core defined in claim 12, wherein said wires and said strands are made of at least 95% zinc.

23. The bullet core defined in claim 12 wherein said wires and said strands are made of approximately 99% zinc.

24. The bullet core defined in claim 12, wherein said wires and said strands are made of about 99.99% zinc.

25. The bullet core defined in claim 12, wherein said wires and said strands are made of at least 95% zinc, and (e) a copper jacket enclosing said rear end portion of said member;

(f) a metal cartridge casing enclosing said copper jacket and said bullet core and having head, rim, main body and mouth portions;

(g) a primer located within said head portion of said casing; and (h) propellant located within said main body portion in close proximity to said primer;

(i) said jacket and said member being secured within said mouth portions of said metal cartridge casing in tight-fitting relation and extending forwardly therefrom.

* * * * *